US005873471A

United States Patent [19]

Ruggeri

[11] Patent Number: 5,873,471

[45] Date of Patent: Feb. 23, 1999

[54] PORTABLE GOLF CLUB SUPPORT

[76] Inventor: George J. Ruggeri, 74 Clinton St., Malverne, N.Y. 11565

[21] Appl. No.: 709,171

[22] Filed: Sep. 6, 1996

[51] Int. Cl.[6] ..... A63B 55/00

[52] U.S. Cl. ..... 211/70.2; 248/688; 273/482

[58] Field of Search ..... 211/70.2; 273/482; 248/156, 688, 691, 150, 155.1; 206/315.2

[56] References Cited

U.S. PATENT DOCUMENTS

| | | | |
|---|---|---|---|
| 1,443,230 | 1/1923 | Luckett . | |
| 2,091,298 | 8/1937 | Agnew . | |
| 2,109,727 | 3/1938 | Klein | 211/73 |
| 2,564,318 | 8/1951 | Wick . | |
| 2,593,783 | 4/1952 | Mitchell | 248/156 X |
| 3,966,051 | 6/1976 | Hollister et al. | 211/14 |
| 4,940,201 | 7/1990 | Kurth | 248/156 X |
| 5,080,239 | 1/1992 | Rowland | 211/70.2 |
| 5,127,530 | 7/1992 | Ortuno | 211/70.2 |
| 5,417,334 | 5/1995 | Wu | 211/70.2 |
| 5,467,980 | 11/1995 | Weisentein | 473/282 |
| 5,597,363 | 1/1997 | Leote | 473/282 |

*Primary Examiner*—Ramon O. Ramirez
*Attorney, Agent, or Firm*—Whitman Breed Abbott & Morgan, LLP

[57] ABSTRACT

A golf support is provided having a first vertical post with a flared and sharpened end driven into the ground, the upper end of which post is pivotally connected with a club support bar which can rotate from a folded position along the post to an open position that extends horizontally. In the open position, the club support bar can support one or more golf clubs leaned against it.

9 Claims, 4 Drawing Sheets

PORTABLE GOLF CLUB SUPPORT

FIELD OF THE INVENTION

This invention relates to supports for golf clubs and, more particularly, to supports that can be carried with the golf clubs when a golfer is carrying just a few clubs.

DESCRIPTION OF THE PRIOR ART

A problem is presented in playing golf in that frequently, the golfer leaves the bag of clubs and, carrying a few clubs, goes to take a further stroke. While taking the stroke, however, only one club is used, and the others are often simply left on the ground and exposed to various types of damage.

The prior art discloses a number of golf club stands.

U.S. Pat. No. 5,080,239 to Rowland shows a spiked device which is inserted into the ground and has chains in which the handles of the golf clubs may be inserted to support them. This arrangement has a number of relatively complicated moving parts and is difficult to use comfortably.

U.S. Pat. No. 2,091,298 to Agnew shows a golf club holder in the form of a rather complex box structure which is unnecessarily heavy.

U.S. Pat. No. 2,564,318 to Wick discloses a golf club carrier and stand which is also unnecessarily heavy due to its bottom structure and its double supportive rod structure.

U.S. Pat. No. 5,127,530 to Ortuno shows a golf club stand which is driven into the ground, but has an upper part which is large enough to create an awkward structure to carry, making it necessary to clip it over the lip of the golf bag to prevent it from getting in the way.

SUMMARY OF THE INVENTION

Accordingly, it is an object of the present invention to provide a portable golf club support suitable to be carried with other clubs in a golf bag, but which has none of the drawbacks of the prior art.

In the apparatus described herein, a post member extends vertically from a lower end which is configured to be pressed into the soil surface of the golf course to an upper end portion at least 18 inches above the soil surface. A club support portion is pivotally connected with upper portion of the post and is rotatable between a folded position where the support portion extends generally adjacent the upper portion of the post, and an open position where the club support portion extends generally horizontally. The club support portion provides a supportive engagement structure that can support one or more golf clubs leaning against it.

It is further an object of this invention to provide a structure of portable golf club support that is light and inexpensive to manufacture, yet still strong enough to securely support one or more golf clubs.

DETAILED DISCLOSURE OF THE INVENTION

Figure 1:
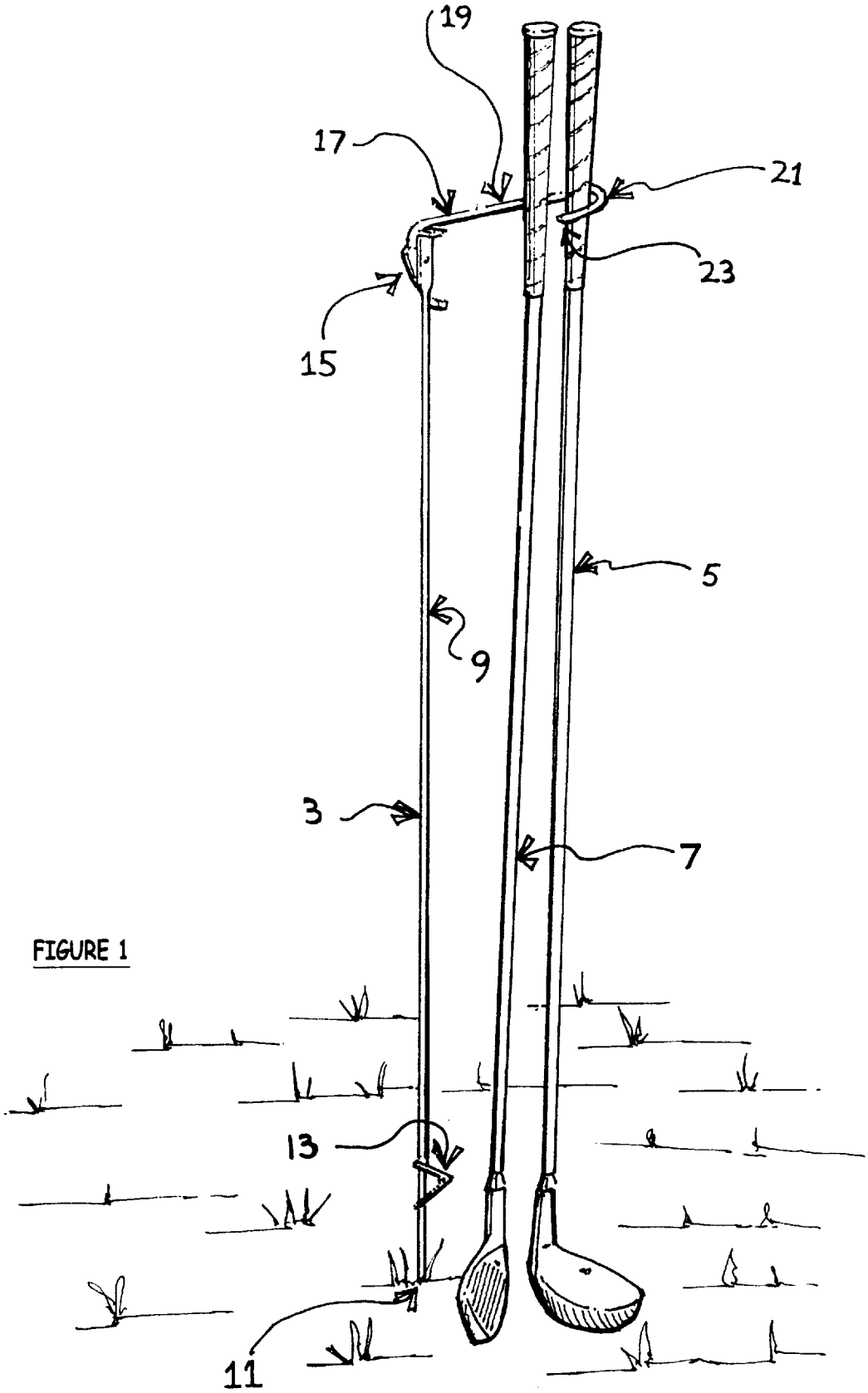
FIG. 1 shows a perspective view of a golf club support of the present invention showing two golf clubs supported thereon.

As best shown in FIG. 1, a golf club support generally indicated at 3 is provided to support one or more golf clubs 5 and 7 leaning thereagainst.

The golf club stand has a first generally vertical shaft member on post 9 with a lower end 11 pressed into the soil surface of the golf course. To assist in pressing the shaft 9 into the ground, the shaft is equipped with a foot pressure ledge 13 on which the golfer can place his or her foot and push the lower end 11 into the soil surface.

Shaft 9 has an upper terminal end 15 at least 18 inches and most preferably about 32 inches above the soil surface, and 15 which is pivotally connected to a golf club support member 17 which provides a generally horizontally extending golf club support portion or bar 19 against which golf clubs may be rested so as not to throw them on the ground.

Golf club support portion 19 is formed integral with a generally arcuate portion 21 which curves horizontally back towards the first shaft 9 to reach a terminal end 23. This arcuate portion 21 is provided to catch the golf clubs so that the golf clubs do not slide off engagement with bar 19, but rather rest relatively securely thereagainst.

Figure 2:
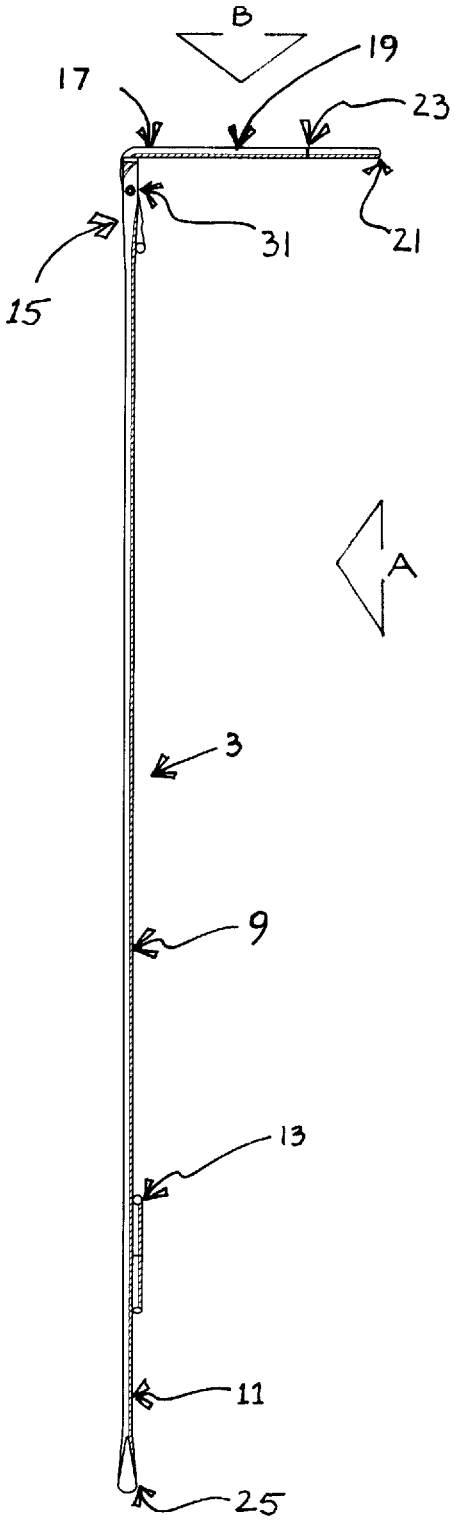
FIG. 2 discloses a front elevational view of the golf club support in the open position.

As best shown in FIG. 2, the lower end of shaft 9 has a sharpened portion 25 which is flattened and flared to provide a sharpened point that can be pushed into the ground readily, but that also is wide enough to prevent rotation of the shaft 9 while the golf support 3 is inserted into the ground.

Shaft 9 is preferably about 39½ inches in length. Foot step structure is preferably about 9½ inches from the lower tip 25 of shaft 9. Shaft 9 is formed of low carbon stainless steel and is most preferably 304 annealed stainless steel wire, cylindrical in shape with a diameter of about ¼ inch. This material is rigid and stiff and provides a degree of flexibility when pressure is applied to it, but it readily returns to its original shape. The foot step structure 13 is formed of a generally V-shaped piece of ¼ inch stainless similar to that used in shaft 9 and is welded into position at two places 27 and 29 adjacent to the shaft 9.

Figure 3:
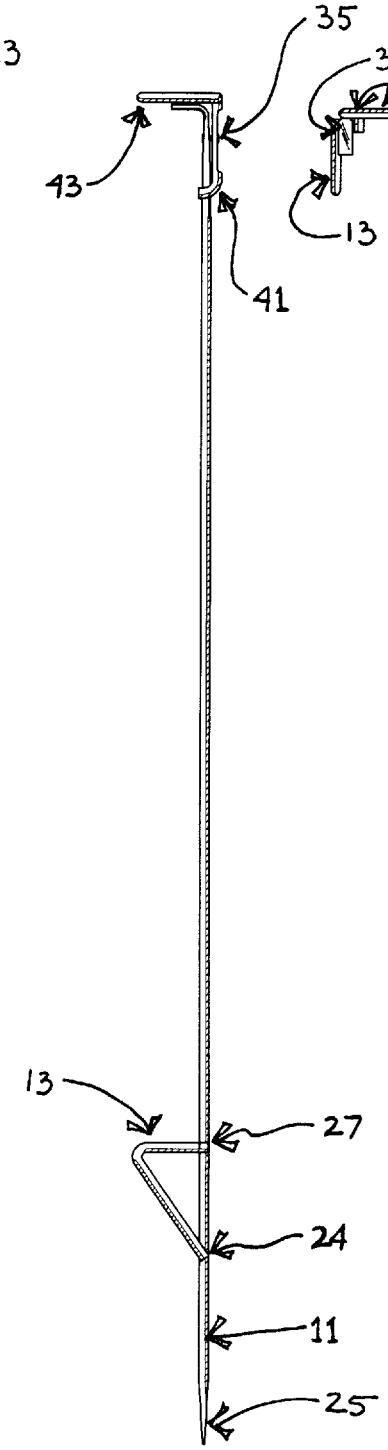
FIG. 3 shows a view taken from line A—A in FIG. 2.
Figure 4:
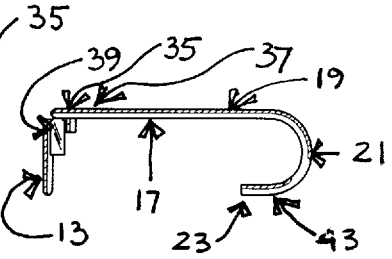
FIG. 4 shows a view taken from line B—B in FIG. 2.
Figure 5:
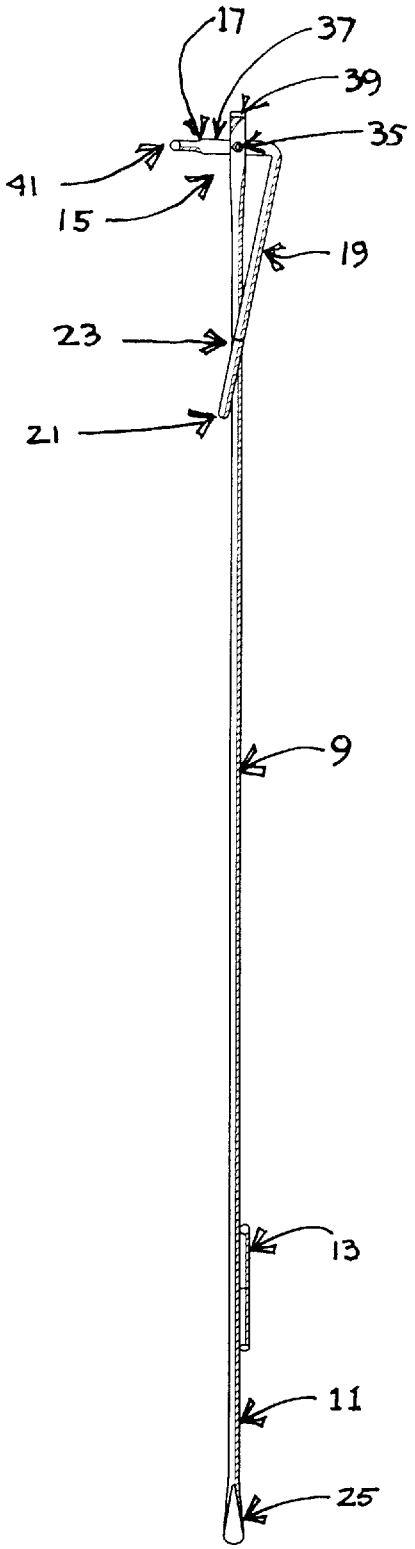
FIG. 5 is a view as in FIG. 2, but showing the golf club stand in a folded or closed position.
Figure 6:
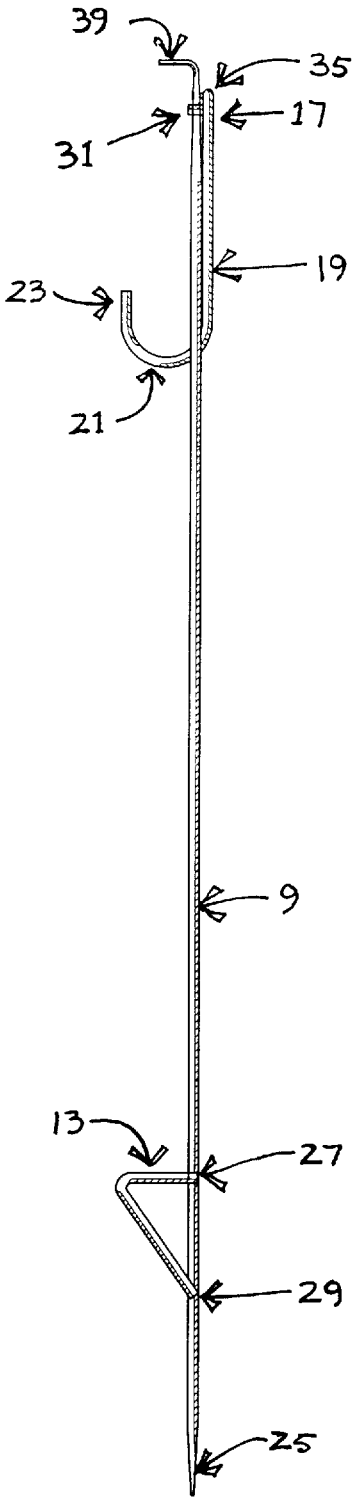
FIG. 6 is a view as in FIG. 3 showing the golf club stand of the present invention in the closed position.

As best shown in FIG. 2, the upper end 15 of shaft 9 has a pivotal connection 31 to club support member 17. This pivotal connection permits movement of the golf club support member 17 between an open or unfolded position, shown in FIGS. 2, 3, and 4, to a folded or closed position, shown in FIGS. 5 and 6, wherein the support portion 19 extends generally alongside the shaft 9.

Figure 7:
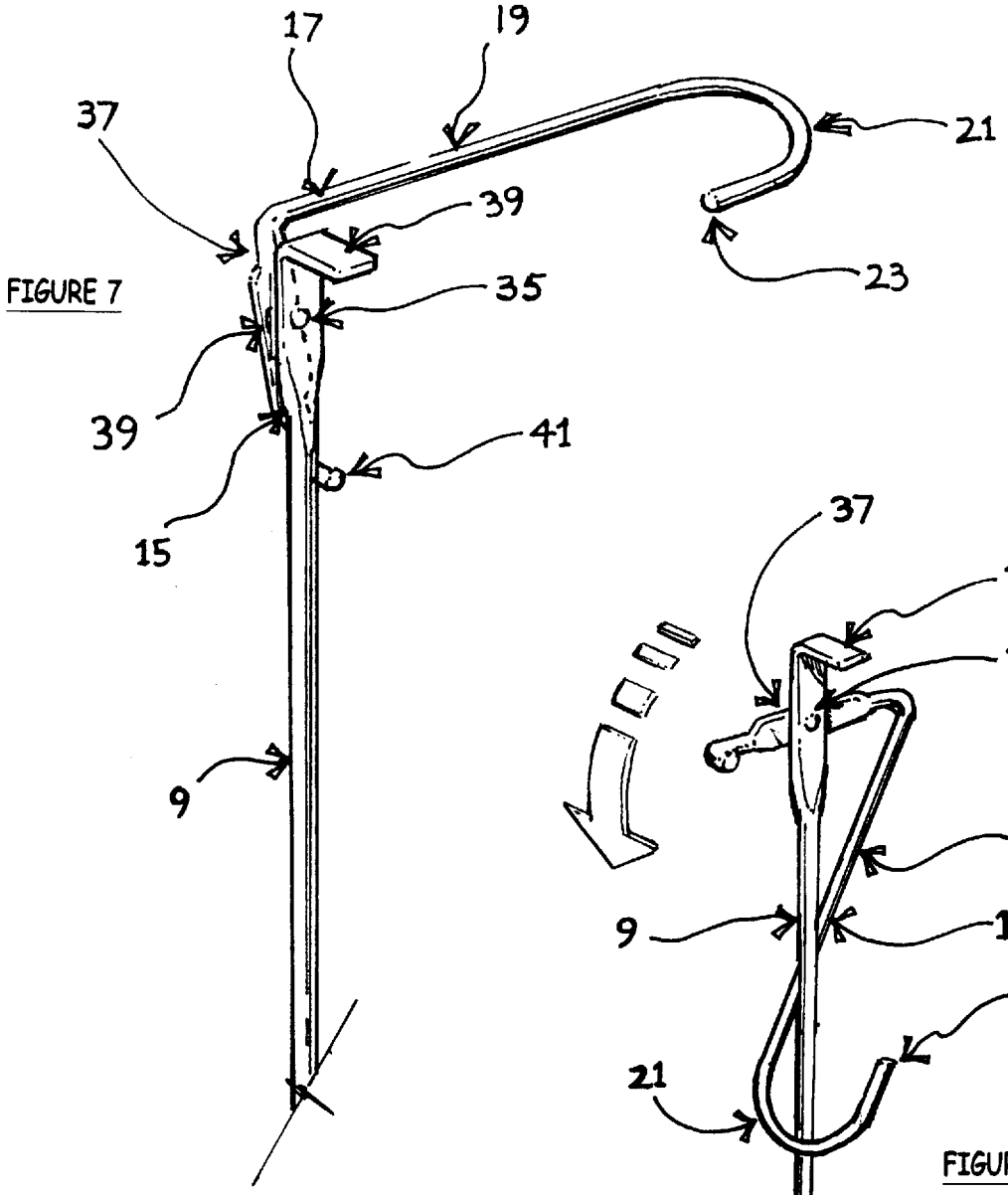
FIG. 7 is a perspective view of the upper end and golf club support portion of the golf club support of the present invention in the open position.
Figure 8:
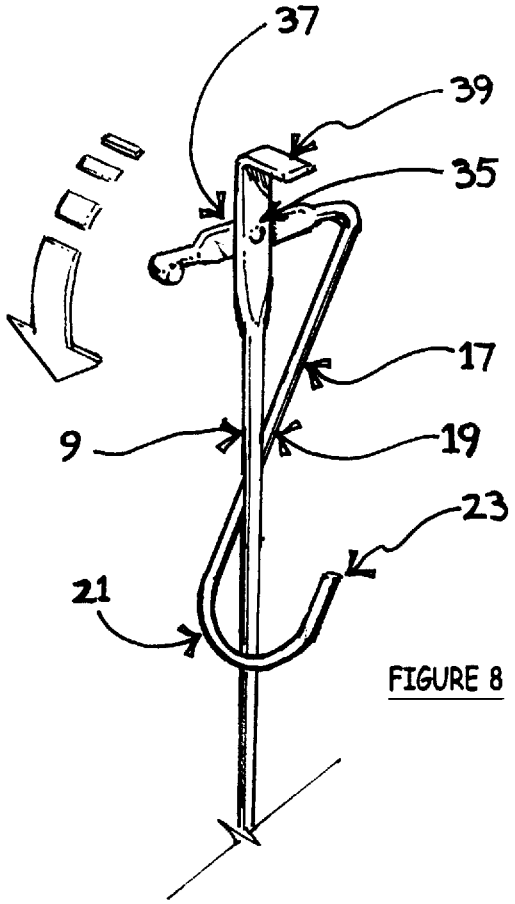
FIG. 8 is a view as in FIG. 7, but showing the golf club support in the closed or folded position.

This operation of the pivotal connection is best shown in the detailed views of FIGS. 7 and 8. As best seen in FIG. 7, upper end 15 of shaft 9 is provided with a flattened portion 33 through which a cold-headed rivet 35 is placed. Golf club support member 17 has, adjacent this location, a flattened, flared portion generally indicated at 37, which also has an aperture therein which receives therein the cold-head rivet 35 for pivotal movement of the support portion 17 relative to the post portion 9. A nylon grommet indicated at 39 is also provided to provide for easily rotational movement between these two parts.

The upper end of flattened portion 33 is folded over into a generally horizontal portion 39 which provides enough of a surface area so that a user can place his or her hand on the top of the post and push it into soft soil. The horizontal portion 39 may also optionally support an injection-molded clip 40 which slides thereon. This clip 40 is shown in exploded form in FIG. 8, and is configured to support a cigarette or cigar.

In order to support the golf club engagement structure 19 of golf club support member 17 at a horizontal angle, the golf club support portion 17 is provided with an abutting stop structure indicated at 41 which extends downwardly from the flared portion 37 and partially wraps around the end portion 15 of post 9, providing a secure supporting abutment which keeps the golf support portion 19 generally horizontal.

From the position shown in FIG. 7, the golf club support portion can be rotated approximately 270° about the pivotal connection provided by rivet 35.

When the club support member 17 is rotated so that it rests adjacent the shaft 9, as shown in FIG. 8, this alters the overall dimensions of the golf club stand so that it can readily be placed in a golf club bag with other clubs without having the support portion sticking out in an inconvenient fashion.

The golf club support portion is preferably formed of ¼ inch stainless steel similar to that used in the post 9. Alternatively, injected molded plastic, or other material, may be used to form this portion of the portable golf stand.

The lateral lengths of the golf club support portion 17 in the open position is preferably about 7½ inches, and the width of accurate portion 21 is preferably about 2 inches.

The club support portion 17 is also provided with a cigarette holder in the form of generally V-shaped bend portion 43 adjacent end portion 23. This bend portion 43 is configured so as to securingly receive a cigarette or cigar therein so that, in addition to placing the unused clubs against the support 3, the golfer can also set aside his or her smoke while using the golf club.

Various finishes may be used to cover the parts of this golf club stand, including a powder-coated paint finish, vinyl dip, or an electroplating process.

The terms used herein should be viewed as terms of description rather than of limitation, as those skilled in the art having this specification before them will be able to make modifications and variations therein without departing from the spirit of the invention thereof.

Wherefore I claim:

1. A portable golf club support for supporting one or more golf clubs, said golf club support comprising:

a post member having a lower end configured to be pressed into a soil surface, said post member extending generally vertically from said lower end and having an upper portion at least 18 inches above said soil surface;

a club support portion connected with said upper portion and being rotatable thereon between a folded position wherein said club support portion extends generally adjacent said upper portion and an open position wherein said club support portion is supported to extend generally horizontally away from said upper portion of said post member;

said club support portion providing a supportive engagement structure being supported at a height above the lower end such that upper ends of said one or more golf clubs with lower ends on the soil surface can engage said supportive engagement structure and said clubs can lean thereagainst at an angle close to vertical when said lower end of said post member is pressed into said soil surface; and said lower end being sharpened and flared to facilitate pressing thereof into the soil surface and to present rotation of the post in said soil surface when said golf clubs are leaned thereagainst;

said supportive engagement structure having a hairpin portion extending horizonally and curvingly so as to provide a partially arcuate structure preventing the golf clubs from sliding out of engagement with the supportive engagement structure.

2. The invention according to claim 1 and said club support portion having a holder structure configured to support a cigar or a cigarette.

3. The invention according to claim 1, and said post member being formed from a metallic rod and said lower end being flattened and flared so as to facilitate pressing of said lower end into the soil surface and to prevent rotation of said rod in the soil surface when said golf club is leaned against said club support portion.

4. The invention according to claim 3, and said rod being generally circular in cross section.

5. The invention according to claim 1, and said post member having a generally horizontally extending structure configured so as to be engageable by the foot of a user of the golf club support to press said lower end into the soil surface.

6. The invention according to claim 1, and said club support portion having a first portion pivotally engaging the upper portion and extending generally straight laterally therefrom in the open position, and a second portion formed integral with said first portion distal to said upper portion, said second portion providing the arcuate structure preventing the golf club sliding along said first portion from falling out of engagement with said club support portion.

7. The invention according to claim 1, and said club support portion being made of plastic material.

8. The invention according to claim 1, and said club support portion being made of metallic wire material.

9. A portable golf club support comprising:

a first generally vertical metallic shaft portion having a lower end that is pressed into a soil surface and that is flared so that rotation of the shaft portion in said soil surface is resisted;

a generally horizontally extending foot pressure structure providing an engagement portion upon which a user can place a foot and apply force thereupon to press said lower end into said soil surface;

said shaft portion extending generally vertically from said soil surface and having an upper terminal end approximately 30 inches above said soil surface, said upper terminal end having a pivotal connector therein; and a club support portion pivotably associated with said pivotal connector for movement between a folded position and an open position;

said club support portion having an abutment portion engaging the upper terminal end of the shaft portion when the club support portion is in the open position, said abutment portion supporting the club support portion in the open position;

said club support portion further comprising a bar portion extending generally adjacent said shaft member in the closed position and extending generally horizontally away from said upper terminal end in the open position, said bar portion in the open position being supported at a height above the lower end such that upper ends of one or more golf clubs with lower ends on the soil surface can engage said bar portion and said clubs can lean thereagainst at an angle close to vertical when said lower end of said shaft member is pressed into said soil surface;

said bar portion having a hairpin portion extending horizontally and curvingly so as to provide a partially arcuate structure preventing the golf clubs from sliding out of engagement with the bar portion.

* * * * *

UNITED STATES PATENT AND TRADEMARK OFFICE

CERTIFICATE OF CORRECTION

PATENT NO. : 5,873,471
DATED : February 23, 1999
INVENTOR(S) : George J. Ruggeri It is certified that error appears in the above-identified patent and that said Letters Patent is hereby corrected as shown below:

Column 4, line 4, for "present" read -- prevent --.

Signed and Sealed this

Twenty-ninth Day of June, 1999

*Attest:*

Q. TODD DICKINSON

*Attesting Officer*

*Acting Commissioner of Patents and Trademarks*